United States Patent [19]

Ohtani et al.

[11] 4,375,377

[45] Mar. 1, 1983

[54] STEELS WHICH ARE USEFUL IN FABRICATING PRESSURE VESSELS

[75] Inventors: Hiroo Ohtani; Seiichi Watanabe, both of Amagasaki, Japan

[73] Assignee: Sumitomo Metal Industries, Limited, Osaka, Japan

[21] Appl. No.: 237,958

[22] Filed: Feb. 25, 1981

[51] Int. Cl.[3] ..... C21D 8/02

[52] U.S. Cl. ..... 148/12 F; 148/12.3

[58] Field of Search ..... 75/126 C, 126 P; 148/12 F, 36, 12.3

[56] References Cited

U.S. PATENT DOCUMENTS 3,251,682 5/1966 Wada ..... 75/126 P
3,288,600 11/1966 Johnsen, Jr. et al. ..... 75/126 P
3,463,677 8/1969 Nakamura et al. ..... 75/126 P

FOREIGN PATENT DOCUMENTS 39-22483 10/1964 Japan ..... 75/126 C
52-62121 5/1977 Japan ..... 148/36
55-40091 10/1980 Japan ..... 148/36
56-251 1/1981 Japan ..... 75/126 P

*Primary Examiner*—Peter K. Skiff
*Attorney, Agent, or Firm*—Watson, Cole, Grindle & Watson

[57] ABSTRACT

Chromium-molybdenum steels which have high strengths, good hydrogen attack resistivities, good high-temperature ductilities and high creep rupture strength, and which, when formed into steel plates, welded and given a high-temperature strain relief annealing treatment will acquire high resistivity to creep damage, comprises 0.11 to 0.17% of C, 0.50 to 1.20% of Si, 0.46 to 1.00% of Mn, 1.00 to 1.50% of Cr, 0.45 to 0.65% of Mo, 0.00015 to 0.0015% of B, 0.010 to 0.100% of Sol. Al and inevitably entrained impurities, the balance to make up 100% of Fe. Preferably the inevitable nitrogen and phosphorus impurities are kept below 0.0060% of N and 0.010% of P.

4 Claims, 2 Drawing Figures

STEELS WHICH ARE USEFUL IN FABRICATING PRESSURE VESSELS

BACKGROUND OF THE INVENTION

1. Field of the Invention

The present invention relates to a method of manufacturing steel plates which are useful in fabricating pressure vessels, and more particularly it relates to improved chromium-molybdenum type steels which can be formed into thick plates that are weldable together to make chemical pressure vessels.

2. The Prior Art

Chemical pressure vessels, such as pressure vessels used as oil-refining reactors, must be fabricated from materials which excel in high temperature strength, creep strength and hydrogen-attach resistivity. The most widely used materials have been 1¼Cr-0.5Mo type steels, which are standarized steels as discussed, for example, in ASTM A387 G11.

In recent years, however, pressure vessels have been growing larger and larger in size, thus requiring the use of steel plates having increasing thicknesses (e.g., of 100 mm or more). Conventional 1¼Cr-0.5Mo type steels, which are generally produced using normalizing and tempering treatments, have not produced completely satisfactory steel plates having such great thicknesses. This is due to the fact that as the plate thicknesses increase, the steel plate cooling speed is reduced and the ferrite content will increase during the normalizing treatment. The temperature of the stress relief annealing after welding or post weld heat treatment (hereinafter abbreviated as PWHT) thus must be elevated and the treatment duration lengthened. As a result, the strength of the produced steel will be drastically lowered. Consequently, the produced steel plates will often times not have the required strengths for use in making pressure vessels. At the same time, however, increasing the content of alloying elements such as chromium and molybdenum will not solve the problem because the weldability of the steel plates will be reduced.

In addition, it has recently been discovered that the occurrence of creep damage in pressure vessels in welded heat affected zone (hereinafter abbreviated as HAZ), accompanied by stress concentration, has become a serious problem.

Investigations on the creep damage have revealed that at normal operation temperatures of pressure vessels (400°-550° C.), the hardened zones suffer from much degradation of grain-boundary strength, and that owing to the concentration of strain in the grain boundaries, cracks develop at the boundaries which grow and mature into ruptures. The most effective way to prevent creep ruptures is to enhance the strength of the base metal and to soften the HAZ by applying a high-temperature PWHT (650°-720° C.). With respect to enhancing the strength of the base metal, this can be achieved by lowering the phosphorus content. However, drastically decreasing the phosphorus content (e.g., to less than 0.010%) entails huge cost increases because a special treatment step in the steelmaking operation becomes necessary.

One proposal for solving the noted problems is disclosed in JA-OS No. 41962/1980 (laid open for public inspection on Mar. 25, 1980). In this proposal, the employed Cr-Mo steel plates have aluminum and boron or boron and titanium added thereto. However, this proposal is basically directed to 2¼Cr-1Mo type steel plates which suffer from severe embrittlement from tempering treatment, and it is also directed to preventing this embrittlement by lowering the silicon and manganese contents. When this prior art proposal for improving steel properties is applied to 1¼Cr-0.5Mo steel plates which have thicknesses exceeding, for example, 50 mm, the steel plates will have insufficient strengths and toughnesses because of the low manganese contents. Indeed, because the silicon contents are kept low, the chromium and molybdenum contents must be increased to achieve the necessary strengths. This detrimentally increases the cost of production, and the produced steel plates still lack the extra strength needed for withstanding the high temperature PWHT and do not show improved creep rupture resistivity.

It is thus an object of the present invention to provide an improved method of producing Cr-Mo type steel plates which can be formed into extremely thick plates for use in fabricating pressure vessels, which plates will have increased strengths (even after high temperature PWHT) and enhanced creep rupture resistivity, yet will not have reduced weldability or increased cost.

SUMMARY OF THE INVENTION

We, the present inventors, have found that Cr-Mo type steel plates, and especially 1¼Cr-0.5Mo steel plates, will display all of the required properties when 0.00015 to 0.0015% of boron and 0.01 to 0.100% of Sol. Al have been incorporated therein after addition of at least 0.46% of Mn. We have found that the addition of this specific amount of Sol. Al and the noted minute amount of boron to the Cr-Mo steel curbs the ferrite transformation during the normalizing treatment, gives rise to a bainite structure and enhances the steel's strength. We have found that when the cooling speed is lowered, the excess amount of boron is precipitated in the austenite grain boundary, which promotes the ferrite transformation and lowers the strength. Therefore, the very minute boron addition proves advantageous in enhancing hardenability during normalizing.

DETAILED DESCRIPTION OF THE INVENTION

Figure 1:
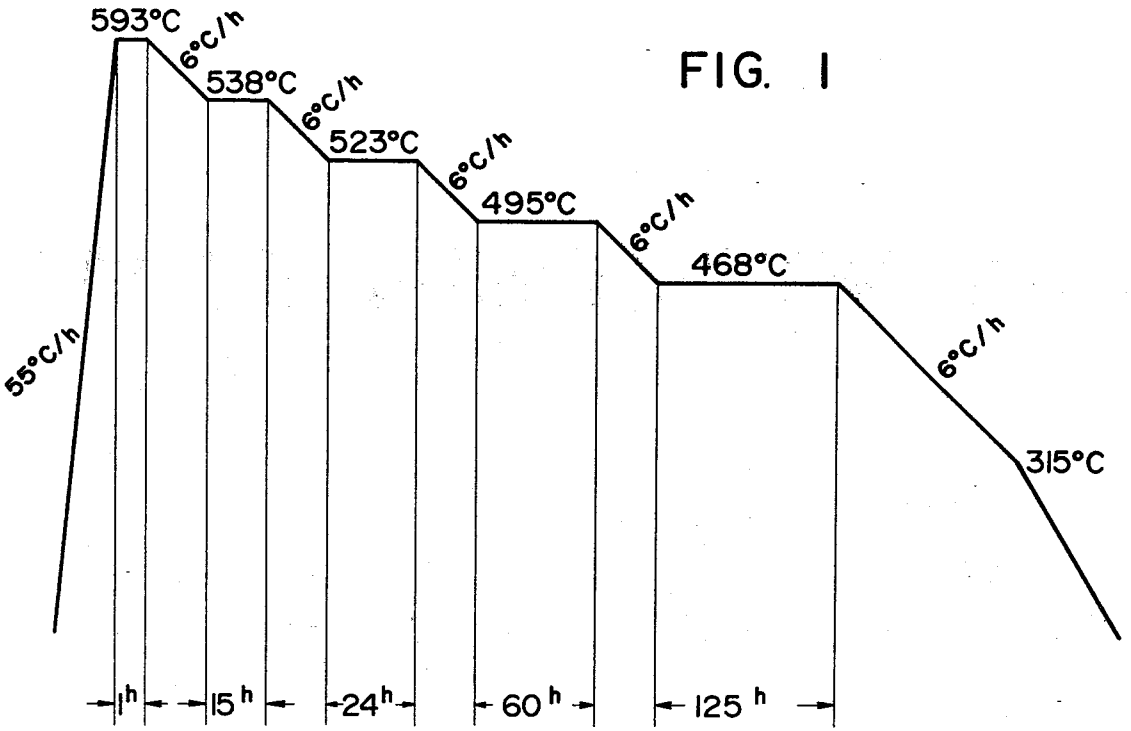
FIG. 1 is a diagram showing a heat pattern of "step cooling" that is an accelerating process to learn a temper embrittlement for short time.

The inventors have discovered that a steel composition containing 0.11 to 0.17% of C, 0.50 to 1.20% of Si, 0.46 to 1.00% of Mn, 1.00 to 1.50% of Cr, 0.45 to 0.65% of Mo, 0.00015 to 0.0015% of B, 0.010 to 0.100% of Sol. Al and the balance (to make up 100%) of Fe (together with impurities inevitably entrained by the components of the composition) gives highly favorable results. A further explanation of the reasons behind the required ranges noted for the carbon, silicon, manganese, chromium, molybdenum, boron and Sol. aluminum are as follows.

Carbon is a primary element for achieving the necessary product strength. To fulfill this purpose, carbon must be added in an amount of not less than 0.11%. If the carbon content exceeds 0.17%, however, the excess carbon results in reduced toughness and weldability. Thus, the carbon content must be from 0.11 to 0.17%.

Silicon is necessary, if not solely, for deoxidation. With the steel of the present invention, an important purpose of the use of silicon is to help the base metal acquire strength, both at room temperature and at elevated temperatures. For this purpose, the silicon must be added in an amount of not less than 0.50%. If the silicon content exceeds 1.20%, however, the excess silicon causes serious degradation in product toughness. Thus, the silicon content must be from 0.50 to 1.20%. Further, since the toughness of the mother material will be reduced to a slight extent when the silicon content exceeds 0.70%, the preferred silicon content is from 0.50 to 0.70%. This amount will be used in steels in which the product toughness will be of greatest importance.

In order to have an enhanced hardenability during the normalizing treatment and in order to help very thick steel plates to acquire strength and toughness, manganese must be added in an amount of not less than 0.46%. If the manganese content exceeds 1.00%, however, the excess manganese degrades the product weldability. Thus, the manganese content must be from 0.46 to 1.00%.

Molybdenum is necessary for heightening the product hardenability during the normalizing treatment and for enhancing its strength both at room temperature and at elevated temperatures. For this purpose, molybdenum must be added in an amount of not less than 0.45%. If the molybdenum content exceeds 0.65%, however, the excess molybdenum adds to the product's strength but causes a loss in its toughness. Thus, the molybdenum content must be from 0.45 to 0.65%.

Chromium serves to heighten the product's hardenability during the normalizing treatment and to enhance hydrogen attack resistivity. To achieve these results, the chromium must be added in an amount of not less than 1.00%. If the chromium content exceeds 1.50%, however, the excess chromium acts to degrade weldability (also, 1.50% is the upper limit specified by the ASTM standard). Thus, the chromium content must be from 1.00 to 1.50%. Further, since hydrogen attach resistivity increases in direct proportion to an increase in the chromium content (possible dispersion of chromium content under normal production conditions being also be taken into account), the preferred chromium content is from 1.25 to 1.50%.

Boron is capable of enhancing the product's hardenability during the normalizing treatment as described above. To help the steel of this invention acquire the micro-structure consisting essentially of bainite, boron must be added in an amount of not less than 0.00015%. If the boron content exceeds 0.0015%, however, the excess boron heightens susceptibility to PWHT cracking, induces precipitation of ferrite during the normalizing treatment and degrades strength. Thus, the boron content is from 0.00015 to 0.0015%. Further, to ensure the effect of boron upon the hardenability and lessen possible dispersion of strength, boron is preferably added in an amount of not less than 0.0002%. When the boron content exceeds 0.0009%, the excess boron acts to impair the toughness of the heat affected zone. Therefore, boron is preferably used within the range of from 0.0002 to 0.0009%.

The Sol. Al is necessary for fixing nitrogen in the form of AlN and for ensuring thorough deoxidation of the steel. To fulfill this purpose, the Sol. Al must be added in an amount of not less than 0.010%. If the Sol. Al content exceeds 0.100%, however, the excess Sol. Al acts to impair hot workability and causes surface cracks on the steel slabs. Thus, the Sol. Al content must be from 0.010 to 0.100%. To ensure the positive effects of boron, the Sol. Al is preferably added in an amount of not less than 0.035%. If the Sol. Al content exceeds 0.065%, however, the excess Sol. Al acts to degrade the toughness of HAZ. Thus, the preferred Sol. Al content is from 0.035 to 0.065%.

Nitrogen, being one of the inevitably entrained impurities, is generally contained in an amount of not more than 0.010%. If the nitrogen content exceeds 0.0060%, the eventual AlN content increases sufficiently to degrade hot workability. Thus, the nitrogen content is preferably kept below 0.0060%.

Phosphorus, another of the inevitably entrained impurities, segregates itself in the austenite grain boundary and impairs ductility at elevated temperatures. To preclude the degradation of ductility, prevent creep damage and enhance high-temperature ductility and creep ductility, the phosphorus content is preferably not more than 0.010%.

The heat treatment involved in the production of thick plates of steel according to the present invention generally comprises a normalizing step (for example, at 900° to 970° C.) and a tempering step (for example, at 650° to 750° C. for 0.5 to 10-odd hours).

In situations where the nitrogen content is high (for example, when it exceeds 0.0060%), it is desirable to take any one of the following processes in the course of production for the purpose of ensuring the desired effects of boron and in securing the necessary strength.

(1) The heating temperature of slabs for the plate rolling is below 1150° C.;

(2) After the rolling step, the steel plate is gradually cooled at a rate of not more than 30° C./hour;

(3) The normalizing step is performed twice, with the first normalizing operation performed at a higher temperature (950° to 1000° C.) and the last one at a regular temperature (900° to 970° C.).

In order to enhance the hardening effect of boron, it is necessary for the nitrogen to be fixed (or compounded) with aluminum in the form of AlN and for the boron to be converted to free boron prior to normalizing. Since both boron and nitrogen are readily segregated in the austenite grain boundary and conversely aluminum is segregated very little, boron and nitrogen which are in a non-equilibrium state tend to be precipitated, particularly when the nitrogen content is high. Further, when the slab heating temperature is above 1150° C., Al, B and N dissolve into the steel during the slab heating process and BN is easy to be precipitated in proportion to fall of the temperature during and after the plate rolling. The reaction of $BN+Al \rightarrow B+AlN$ can be completed by proceeding it at 1000° C. for 30 minutes or a gradual cooling (lower than 30° C./hr.). Therefore, when the N content exceeds 0.0060%, by performing any one process of heating the slab at below 1150° C., gradual cooling after rolling and high temperature normalizing (950° to 1000° C.) prior to the regular temperature normalizing (900° to 970° C.), the nitrogen is fixed with aluminum to be in the form of AlN and boron is converted to free boron so that the desired hardening effect of boron can be obtained.

In a pressure vessel made of the steels steel plate of this invention, the hardened portion in the HAZ can be softened and the creep rupture resistivity can be improved by performing a high-temperature PWHT. It is, therefore, desirable to give a high-temperature PWHT (650° to 720° C.) to such pressure vessels.

The steel plates made by this invention use chromium in an amount not exceeding the specified upper limit to improve the hydrogen attack resistivity and permit a decrease in the silicon content proportionately to the increase of strength obtained by the chromium. They further use Mn aluminum and boron in the respectively specified optimum amounts. Consequently, there are obtained very tough Cr-Mo steels which have a high hydrogen attack resistivity.

Further, by limiting the content of nitrogen and phosphorus, among the other inevitably entrained impurities, the AlN content can be decreased, the effect of the boron can be ensured and the hot workability can be improved. By lowering the phosphorus content, the creep rupture resistivity can be heightened. Consequently, there are provided steel plates which excel in high-temperature ductility and creep ductility and which will endure under harsh use conditions.

EXAMPLE 1

Steels having the chemical composition as shown in Table 1 were prepared by induction melting. These steels were formed into the plates under the manufacturing conditions shown in Table 2, i.e., by rolling and treatment after the rolling. The mechanical properties of thus formed plates are also shown in Table 2. In Tables 1 and 2, steel No. 1 to No. 4 denote respectively the steels produced by the invention and steel No. 5 and No. 6 denote respectively the steels which are given for comparison.

As shown in Table 2, the steels of the invention displayed enhanced strength even after the high temperature PWHT and, particularly, superior impact property to that of the comparison steels after the step cooling No. 1 and No. 3 steels containing higher N content were subjected respectively to the different special treatments, as indicated by 3-1 and 3-2 in Table 2. Table 2 shows that by double normalizing, heating at a lower temperature for rolling and slower cooling after rolling, very favorable results are obtained.

The steels with high strength and high ductility according to the invention can be annealed at a high temperature after welding (PWHT) so that the creep damage is effectively prevented.

TABLE 1

| | Chemical composition of steels | | | | | | | | |
|---|---|---|---|---|---|---|---|---|---|
| Steel | C | Si | Mn | P | Cr | Mo | B | Sol. Al | N |
| steels of the invention | | | | | | | | | |
| 1 | 0.13 | 0.72 | 0.49 | 0.015 | 1.18 | 0.48 | 0.0012 | 0.072 | 0.0072 |
| 2 | 0.15 | 0.57 | 0.58 | 0.012 | 1.24 | 0.59 | 0.0005 | 0.039 | 0.0058 |
| 3 | 0.12 | 0.65 | 0.61 | 0.013 | 1.45 | 0.62 | 0.0006 | 0.042 | 0.0062 |
| 4 | 0.15 | 0.53 | 0.56 | 0.004 | 1.40 | 0.60 | 0.0007 | 0.043 | 0.0032 |
| steels for comparison | | | | | | | | | |
| 5 | 0.16 | 0.21 | 0.35 | 0.015 | 1.19 | 0.45 | 0.0033 | 0.038 | 0.0073 |
| 6 | 0.13 | 0.63 | 0.56 | 0.008 | 1.22 | 0.52 | — | 0.027 | 0.0064 |

TABLE 2

| | Manufacturing conditions and mechanical properties of steels | | | | | | | | | | |
|---|---|---|---|---|---|---|---|---|---|---|---|
| | | Manufacturing conditions | | | | | | Charpy impact absorbed energy | | | |
| | | | | | | Tensile strength | | PWHT only | | PWHT + *step cooling | |
| | Steel | heating temp. for rolling | cooling rate after rolling | normalizing | PWHT | PWHT only | | vEo | vE-20 | vEo | vE-20 |
| | No. | (°C.) | | (°C. × hr) | (°C. × hr) | YS(kg/mm²) | TS(kg/mm²) | (kg-m) | (kg-m) | (kg-m) | (kg-m) |
| Steels of the invention | 1-1 | 1100 | air cooling | 950 × 1 | 700 × 1 | 38.7 | 58.1 | 14.2 | 10.3 | 10.9 | 6.5 |
| | 1-2 | 1100 | air cooling | 950 × 1 | 700 × 30 | 36.4 | 55.3 | 12.7 | 8.4 | 11.2 | 7.6 |
| | 1-3 | 1250 | cover cooling (10° C./hr) | 950 × 1 | 700 × 1 | 39.6 | 57.8 | 13.1 | 9.5 | 9.7 | 5.6 |
| | 1-4 | 1250 | cover cooling (10° C./hr) | 950 × 1 | 700 × 30 | 37.9 | 56.8 | 12.1 | 8.2 | 10.9 | 6.8 |
| | 1-5 | 1250 | air cooling | 970 × 1<br>930 × 1 | 700 × 1 | 40.2 | 57.9 | 15.9 | 12.1 | 12.7 | 8.6 |
| | 1-6 | 1250 | air cooling | 970 × 1<br>930 × 1 | 700 × 30 | 37.1 | 56.5 | 14.5 | 11.9 | 13.8 | 12.6 |
| | 2-1 | 1250 | air cooling | 950 × 1 | 700 × 1 | 40.2 | 60.2 | 11.7 | 6.4 | 11.3 | 6.7 |
| | 2-2 | 1250 | air cooling | 950 × 1 | 700 × 30 | 37.1 | 57.3 | 10.8 | 5.6 | 11.5 | 5.3 |
| | 3-1 | 1100 | air cooling | 950 × 1 | 700 × 1 | 37.4 | 55.4 | 15.8 | 9.1 | 14.2 | 8.2 |
| | 3-2 | 1100 | air cooling | 950 × 1 | 700 × 30 | 35.9 | 53.8 | 13.6 | 9.3 | 12.3 | 6.8 |
| | 4-1 | 1250 | air cooling | 950 × 1 | 700 × 1 | 42.3 | 60.2 | 18.7 | 13.3 | 17.9 | 12.0 |
| | 4-2 | 1250 | air cooling | 950 × 1 | 700 × 30 | 39.6 | 57.2 | 15.1 | 10.7 | 14.6 | 9.3 |
| | 5-1 | 1250 | air cooling | 950 × 1 | 700 × 1 | 39.5 | 60.2 | 3.2 | 1.5 | 2.3 | 0.5 |
| | 5-2 | 1250 | air cooling | 950 × 1 | 700 × 30 | 36.1 | 55.0 | 1.2 | 0.5 | 1.1 | 0.7 |
| | 6-1 | 1250 | air | 950 × 1 | 700 × 1 | 30.9 | 51.2 | 4.3 | 2.4 | 4.9 | 2.0 |

TABLE 2-continued

| Steel No. | Manufacturing conditions and mechanical properties of steels: Manufacturing conditions: heating temp. for rolling (°C.) | cooling rate after rolling | normalizing (°C. × hr) | PWHT (°C. × hr) | Tensile strength PWHT only YS(kg/mm²) | TS(kg/mm²) | Charpy impact absorbed energy: PWHT only vEo (kg-m) | vE-20 (kg-m) | PWHT + *step cooling vEo (kg-m) | vE-20 (kg-m) |
|---|---|---|---|---|---|---|---|---|---|---|
| 6-2 | 1250 | cooling air cooling | 950 × 1 | 700 × 30 | 27.7 | 49.8 | 1.0 | 0.5 | 1.1 | 0.7 |

*Carried out "step cooling" having the heat pattern shown in FIG. 1.

EXAMPLE 2

Figure 2:
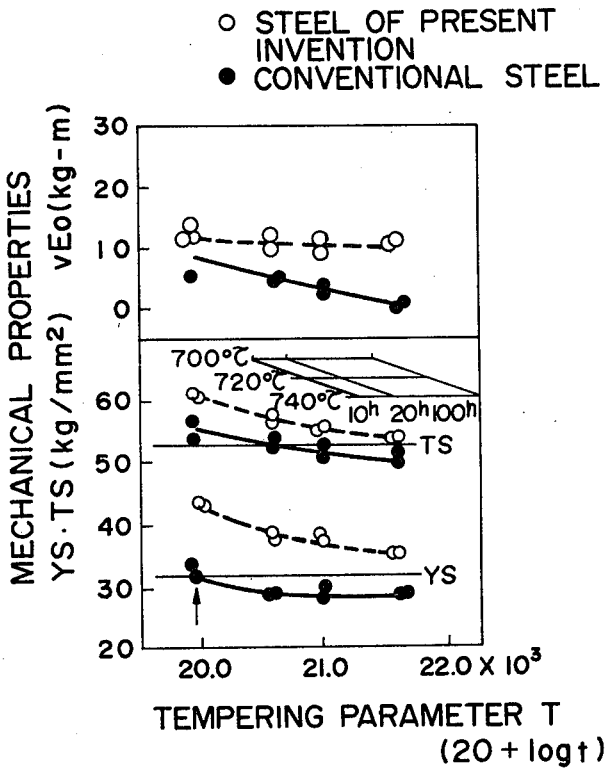
FIG. 2 is a diagram showing the relationship of tempering parameter and mechanical property between the conventional steel and the steel of the invention.

1¼Cr-0.5Mo steel according to the invention and the conventional 1¼Cr-0.5Mo steel, both of which having respectively the chemical compositions as shown in Table 3, were prepared. These steels were heated at 1230° C. and normalized at 930° C. for one hour to investigate the relationship of the tempering parameter with the mechanical properties. The results of the investigation are shown in FIG. 2. As can be seen from FIG. 2, as compared with the conventional steel, the steel of the invention becomes less deteriorated in strength and impact value in proportion to the rise of the tempering temperature. In other words, the steel of the invention is provided with sufficient strength and toughness even by high temperature annealing after welding (PWHT) so as to prevent creep damage in HAZ.

TABLE 3

| Steel | Chemical composition of 1¼Cr—½Mo steels: C | Si | Mn | Cr | Mo | Sol Al | B |
|---|---|---|---|---|---|---|---|
| Conventional steel | 0.16 | 0.65 | 0.60 | 1.40 | 0.60 | 0.025 | — |
| Steel of the invention | 0.14 | 0.65 | 0.60 | 1.40 | 0.55 | 0.055 | 0.0006 |

Variations in the present invention will be apparent to those of ordinary skill in this art and yet still fall within the scope of the appended claims.

We claim:

1. A method of manufacturing a steel plate which consists essentially of 0.11 to 0.17% of C, 0.50 to 1.20% of Si, 0.46 to 1.00% of Mn, 1.00 to 1.50% of Cr, 0.45 to 0.65% of Mo, 0.0002 to 0.0009% of B, 0.010 to 0.100% of Sol. Al, and the balance of Fe, said method including heating a slab for the plate rolling at a temperature of not more than 1150° C.

2. A method of manufacturing a steel plate which consists essentially of 0.11 to 0.17% of C, 0.50 to 1.20% of Si, 0.46 to 1.00% of Mn, 1.00 to 1.50% of Cr, 0.45 to 0.65% of Mo, 0.0002 to 0.0009% of B, 0.010 to 0.100% of Sol. Al, and the balance of Fe, said method including gradually cooling the steel plate at a rate of not more than 30° C./hour immediately after plate rolling.

3. A method of manufacturing a steel plate which consists essentially of 0.11 to 0.17% of C, 0.50 to 1.20% of Si, 0.46 to 1.00% of Mn, 1.00 to 1.50% of Cr, 0.45 to 0.65% of Mo, 0.0002 to 0.0009% of B, 0.010 to 0.100% of Sol. Al, and the balance of Fe, said method including normalizing said steel plate at a temperature of 900° to 1000° C., normalizing the normalized steel plate again at a temperature of 900° to 970° C., and tempering the double-normalized steel plate.

4. A method of manufacturing a steel plate which consists essentially of 0.11 to 0.17% of C, 0.50 to 1.20% of Si, 0.46 to 1.00% of Mn, 1.00 to 1.50% of Cr, 0.45 to 0.65% of Mo, 0.0002 to 0.0009% of B, 0.010 to 0.100% of Sol. Al, not more than 0.0060% of N which is an inevitably entrained impurity, and the balance of Fe, said method including normalizing said steel plate at a temperature of 900° to 970° C., and then tempering the normalized steel plate.

* * * * *